US008419558B2

(12) United States Patent
Zhang

(10) Patent No.: US 8,419,558 B2
(45) Date of Patent: Apr. 16, 2013

(54) CHILD CARRIER APPARATUS AND ITS OPERATING METHOD

(75) Inventor: Xiaojian Zhang, Central Hong Kong (HK)

(73) Assignee: Wonderland Nurserygoods Company Limited, Hong Kong (HK)

( * ) Notice: Subject to any disclaimer, the term of this patent is extended or adjusted under 35 U.S.C. 154(b) by 325 days.

(21) Appl. No.: 12/887,063

(22) Filed: Sep. 21, 2010

(65) Prior Publication Data

US 2011/0070958 A1 Mar. 24, 2011

(30) Foreign Application Priority Data

Sep. 24, 2009 (CN) ..... 2009 1 0178626

(51) Int. Cl.
*A63G 9/16* (2006.01)
*A63G 9/00* (2006.01)

(52) U.S. Cl.
USPC ..... 472/119

(58) Field of Classification Search ..... 472/118–125; 297/273, 274
See application file for complete search history.

(56) References Cited

U.S. PATENT DOCUMENTS

| | | | | |
|---|---|---|---|---|
| 6,010,410 | A * | 1/2000 | Lauro et al. | 472/118 |
| 6,511,123 | B1 * | 1/2003 | Sitarski et al. | 297/130 |
| 7,878,915 | B2 * | 2/2011 | Myers et al. | 472/119 |
| 8,142,297 | B2 * | 3/2012 | Zhang | 472/119 |

* cited by examiner

*Primary Examiner* — Kien Nguyen
(74) *Attorney, Agent, or Firm* — David I. Roche; Baker & McKenzie LLP

(57) ABSTRACT

A child seating apparatus comprises a support frame, a seat assembly mounted with the support frame, a pivot joint and an actuating mechanism. The pivot joint includes a first coupling element connected with the support frame, a second coupling element connected with the seat assembly and pivotally assembled with the first coupling element, and a latching member movable between a first position locking the first and the second coupling element in position, and a second position unlocking the second coupling element from the first coupling element. The actuating mechanism includes a casing, and a handle movably assembled through the casing and is connected with the latching member via a link element, whereby the handle is operable with a single hand to cause the latching member to move from the first position to the second position. In some embodiments, a method of operating the child seating apparatus is also described.

16 Claims, 6 Drawing Sheets

CHILD CARRIER APPARATUS AND ITS OPERATING METHOD

CROSS-REFERENCE TO RELATED APPLICATION

This application claims priority of Chinese application no. 200910178626.0 filed on Sep. 24, 2009.

BACKGROUND OF THE INVENTION

1. Field of the Invention

The present invention relates to a child seating apparatus and its operating method.

2. Description of the Related Art

An infant swing apparatus can provide regular swinging movements that help to comfort a young child or baby placed therein. Currently, the swing apparatus can be implemented in a variety of forms such as swinging chairs, swinging cradles and the like. Conventionally, a swing apparatus comprises a support frame, a seat, and swing arms connected between the seat and the support frame. In some swing apparatus, the inclination of the seat may also be adjustable relative to the support frame. However, the conventional mechanism for adjusting the seat generally uses two release buttons on left and right sides of the seat, which have to be pushed at the same time for unlocking the seat and permitting its rotation relative to the support frame. Such design is not convenient to operate for a user.

Therefore, there is a need for a child seating apparatus that can be manufactured in a cost-effective manner, and address at least the foregoing issues.

SUMMARY

The present application describes a child seating apparatus having an adjustment mechanism that allows convenient adjustment of the seat. In particular, the adjustment mechanism of the swing apparatus can be operated with a single hand for adjusting the inclination of the seat in a convenient manner.

In some embodiments, the child seating apparatus comprises a support frame, a seat assembly mounted with the support frame, at least one pivot joint and an actuating mechanism. The pivot joint includes a first coupling element, a second coupling element, and a latching member, wherein the first coupling element is connected with the support frame, the second coupling element is connected with the seat assembly and is pivotally assembled with the first coupling element, and the latching member is movable between a first position locking the first and second coupling element in position, and a second position unlocking the second coupling element from the first coupling element. The actuating mechanism includes a casing and a handle, wherein the handle is movably assembled through the casing and is connected with the latching member via a link element, whereby the handle is operable to cause the latching member to move from the first position to the second position.

The present application also describes a method of operating the infant swing apparatus. In some embodiment, the method comprises locking the first coupling element with the second coupling element by biasing the latching member to a first position, causing the latching member to move from the first position to a second position that unlocks the first and second coupling elements, and rotating the seat assembly to a different inclination relative to the support frame.

DETAILED DESCRIPTION OF THE EMBODIMENTS

The present application describes a child seating apparatus and its operating method that use an adjustment mechanism allowing convenient adjustment of the seat. In particular, the adjustment mechanism of the swing apparatus can be operated with a single hand for adjusting the inclination of the seat in a convenient manner.

Figure 1:
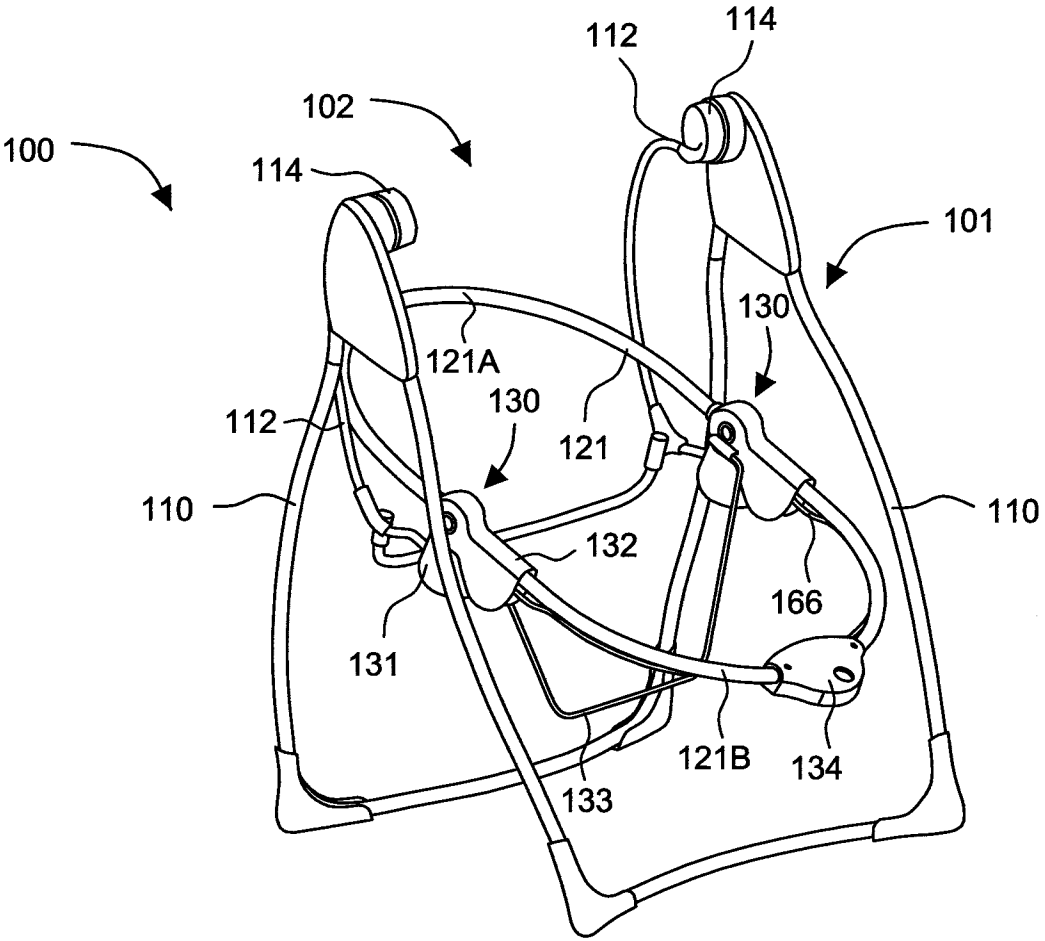
FIG. 1 is a schematic view illustrating one embodiment of a child seating apparatus.

FIG. 1 is a schematic view illustrating one embodiment of a child seating apparatus 100. The child seating apparatus 100 is exemplary an infant swing apparatus. As shown, the child seating apparatus 100 comprises a support frame 101 and a seat assembly 102. The support frame 101 has a left and right side respectively provided with support legs 110. As illustrated, one embodiment can have the seat assembly 102 formed by a tubular structure 121 having a generally oval contour, a rear 121A of the tubular structure 121 corresponding to a backrest of the seat assembly 102 and a front 121B of the tubular structure 121 corresponding to a seating portion. The seat assembly 102, including the tubular structure 121, is assembled between the support legs 110 on the left and right sides of the support frame 101. More specifically, the left and right sides of the seat assembly 102 are respectively coupled with the support legs 110 via swing arms 112. A first (or upper) end portion of each swing arm 112 is coupled with one support leg 110 via a first pivot joint 114, whereas an opposite second (or lower) end portion of each swing arm 112 is coupled with the seat assembly 102 via a second pivot joint 130. The second pivot joints 130 can be disposed approximately at middle sections of the oval tubular structure 121. The swing arms 112 can have a curved shape that lie substantially behind the second pivot joints 130. The swing arms 112 can drive swinging movements of the seat assembly 102 around the pivot axis defined by the two first pivot joints 114, whereas the second pivot joints 130 can enable adjustment of the seat assembly 102 relative to the swing arms 112.

As shown in FIG. 1, each of the two second pivot joints 130 can comprise a first coupling element 131 and a second coupling element 132. The first coupling element 131 is affixed with the associated swing arm 112. The second coupling element 132 is connected with the tubular structure 121, and is operable to rotate relative to the first coupling element 131 and the swing arm 112 for adjusting the inclination of the seat assembly 102 relative to the support frame 101. A fabric fixture 133 may also be provided between the two second pivot joints 130, the left and right distal ends of the fabric fixture 133 being respectively affixed with an inner side of each second coupling element 132. A fabric element (not shown) can be thereby secured with the fabric fixture 133 for defining a seating area of the seat assembly 102. The second pivot joints 130 respectively have an unlocked state where adjustment of the seat assembly 102 is permitted, and a locked state where the seat assembly 102 is locked in position relative to the support frame 101. An actuating mechanism 134 can be provided at the front 121B of the seating portion for switching the two second pivot joints 130 between the locked and unlocked state.

Figure 2:
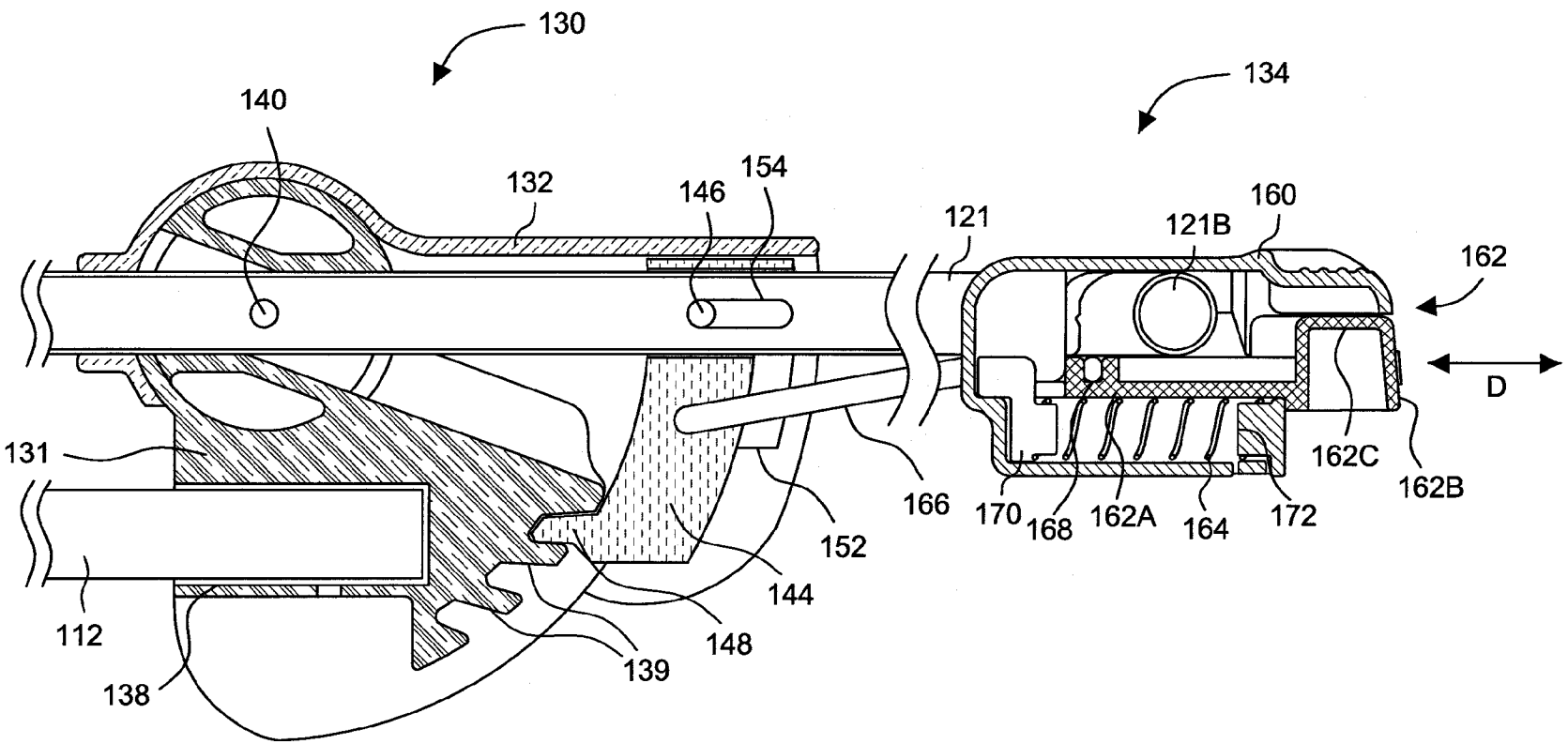
FIG. 2 is a cross-sectional view illustrating the construction of one second pivot joint and actuating mechanism used in the child seating apparatus shown in FIG. 1.

FIG. 2 is a cross-sectional view illustrating the construction of one second pivot joint 130 and actuating mechanism 134. A portion of the first coupling element 131 can comprise a slot 138, and a plurality of locking locations 139 disposed on a side of the first coupling element 131 opposite the side of the slot 138. The swing arm 112 can be inserted and fastened through the slot 138, whereby the first coupling element 131 can be fixedly secured with the swing arm 112. The locking locations 139 can be formed by a plurality of grooves, slots, or like structures. The tubular structure 121 is assembled substantially linear through the second coupling element 132. The first coupling element 131 can include a rounded portion that is rotationally assembled inside the second coupling element 132 via a pivotal link 140 located above the slot 138 where the end portion of the swing arm 112 is fixedly fastened. In one embodiment, the pivotal link 140 can be formed by engaging a pin, rivet or the like through a hole formed through the rounded portion of the first coupling element 131, the tubular structure 121 and second coupling element 132. The tubular structure 121 and the second coupling element 132 are thereby pivotally connected with the first coupling element 131, the locking locations 139 being disposed at different radial directions relative to the pivot axis of the pivotal link 140. Accordingly, the second coupling element 132 and seat assembly 102 affixed therewith can rotate relative to the swing arms 112 and support frame 101 around the pivot axis defined by the pivotal link 140.

As shown, the second coupling element 132 includes a latching member 144 that is mounted in a hollow interior of the second coupling element 132 at a side opposite to the swing arm 112. More specifically, the latching member 144 can have a first portion provided with a pin 146, and a second portion forming an engaging end 148. The latching member 144 may be movably mounted in a guide cavity 152 formed in the second coupling element 132. With the latching member 144 positioned in the guide cavity 152, the pin 146 is movably engaged through an elongated slot 154 provided in the tubular structure 121 parallel to a direction of extension of the guide cavity 152. Guided by the guide cavity 152 and the elongated slot 154, the latching member 144 can slide generally parallel to the linear direction of extension of the tubular structure 121 and along a radial direction relative to the pivot axis of the pivotal link 140. Moreover, as the tubular structure 121 and second coupling element 132 can be positioned at different inclination relative to the first coupling element 131, the engaging end 148 of the latching member 144 can engage with a different locking location 139 for blocking rotation of the tubular structure 121 and second coupling element 132 relative to the first coupling element 131.

Referring to FIG. 2 again, the actuating mechanism 134 can comprise a casing 160, a handle 162 and a spring element 164. The tubular structure 121 has a front end 121B that is fixedly secured inside the casing 160. The handle 162 is movably assembled through the casing 160, and is connected with the latching member 144 via a link element 166 such as an elongated rod. As shown in FIG. 2, the handle 162 has an inner end portion 162A and an outer end portion 162B. The inner end portion 162A includes a groove 168 in which an end portion of the link element 166 can be fixedly secured, and a flange 170. The outer end portion 162B includes a recessed region 162C into which a user can insert his/her fingers for operating the handle 162. The spring element 164 is assembled along a direction of movement of the handle 162 between the flange 170 and an inner sidewall 172 of the casing 160. The handle 162 is limited in a sliding direction D by an abutment 174 (shown in FIG. 3) provided in the casing 160.

Figure 3:
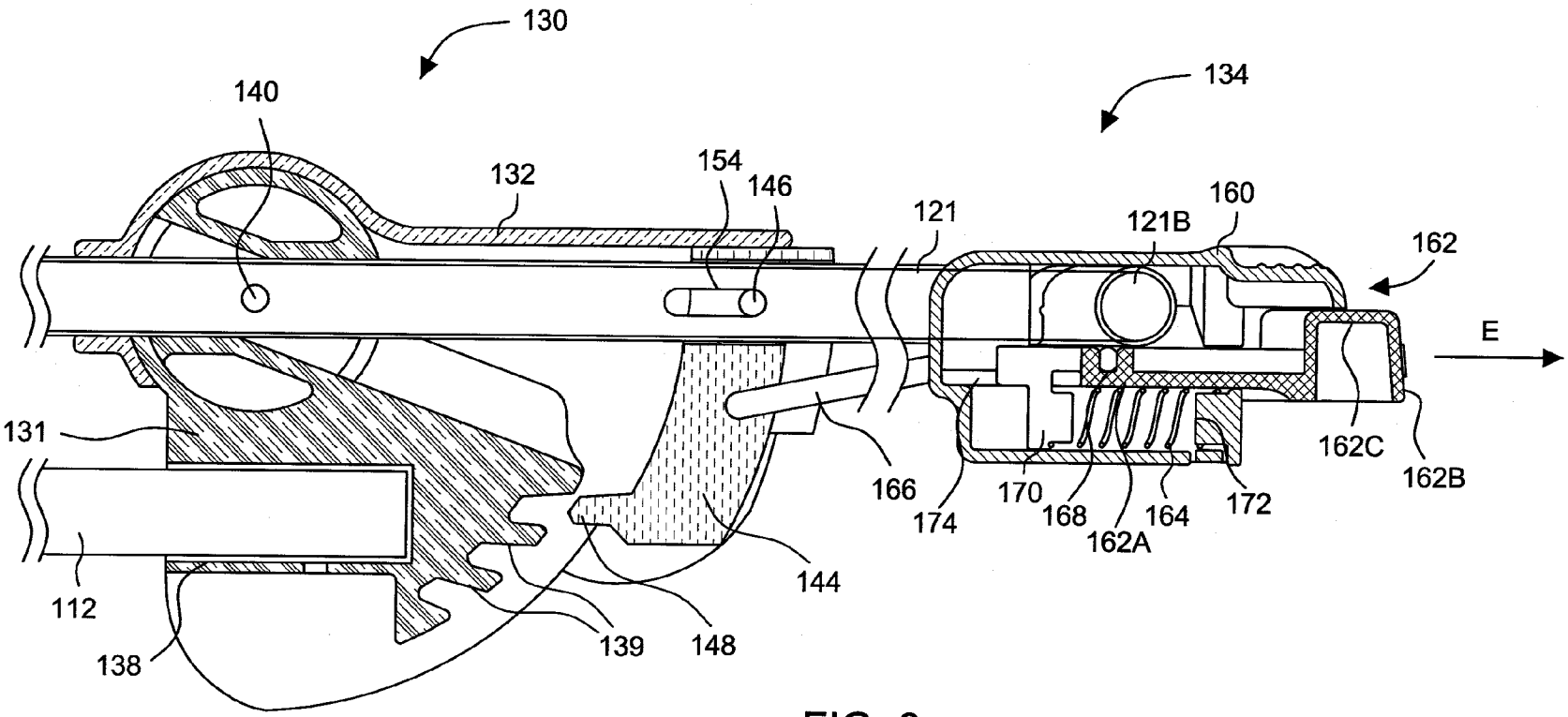
FIG. 3 is a schematic view illustrating the second pivot joint in an unlocked state.
Figure 4:
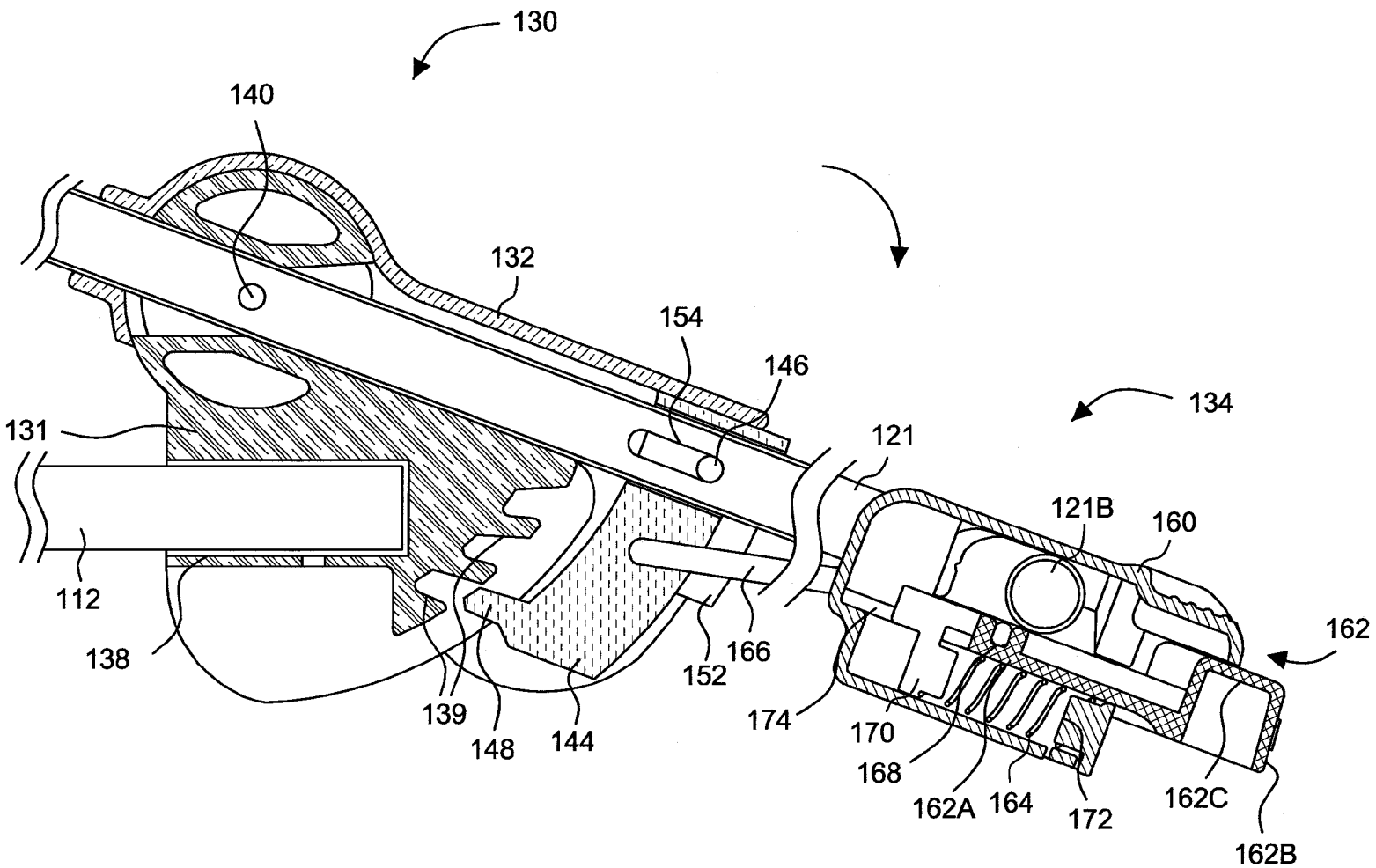
FIG. 4 is a schematic view illustrating the seat assembly after adjustment of its inclination.

Reference is made to FIGS. 2, 3 and 4 for describing an exemplary operation of the second pivot joint 130 and actuating mechanism 134. In FIG. 2, the second pivot joint 130 is in a locked state and the latching member 144 is at a corresponding first position. When the second pivot joint 130 is in the locked state, the spring element 164 can bias the latching member 144, the handle 162 and the link element 166 toward the second pivot joint 130, such that the engaging end 148 of the latching member 144 can engage with one of the locking locations 139. As a result, rotation of the tubular structure 121 and second coupling element 132 about the pivotal link 140 relative to the first coupling element 131 and swing arms 112 can be blocked.

FIG. 3 is a schematic view illustrating the second pivot joint 130 in an unlocked state. For unlocking the second pivot joint 130, a user can grasp the handle 162 at the recessed region 162C, and pull the handle 162 along the direction E (i.e., generally parallel to the direction of extension of the tubular structure 121) toward an outside of the casing 160. As a result, the latching member 144 moves to a second position that disengages the engaging end 148 from the locking location 139, as shown in FIG. 3. The second pivot joint 130 can be thereby switched from the locked state to the unlocked state.

FIG. 4 is a schematic view illustrating the seat assembly 102 after adjustment of its inclination. While the latching member 144 is kept at the second position and the second pivot joint 130 maintained in the unlocked state, the user can use one hand to exert an upward or downward force on the handle 162 for rotating the tubular structure 121 and second coupling element 132 about the axis of the pivotal link 140 relative to the first coupling element 131 and swing arm 112. Once the tubular structure 121 has reached the desired inclination, the user can release the handle 162. Driven by the action of the spring element 164, the handle 162 can slide toward the casing 160, which causes the latching member 144 to move in a direction that drives the engaging end 148 to engage with another locking location 139. The second pivot joint 130 can thereby recover its locked state. As each of the locking locations 139 is associated with a different inclination of the tubular structure 121, the amount of locking locations 139 provided can be used to set the number of adjustable positions of the seat assembly 102.

Because the actuating mechanism 134 is provided at the front of the seat assembly 102, a user can conveniently operate the actuating mechanism 134 for unlocking the second pivot joint 130 and adjusting the inclination of the seat assembly 102 with a single hand. It can be appreciated that the user can also pull the handle 162 and exert a rotational force substantially at the same time for unlocking the second pivot joint 130 and rotating the seat assembly 102. Rather than being operated by a pulling action, the second pivot joint and actuating mechanism may also adopt a construction that is actuated by a pushing action as described below.

Figure 5:
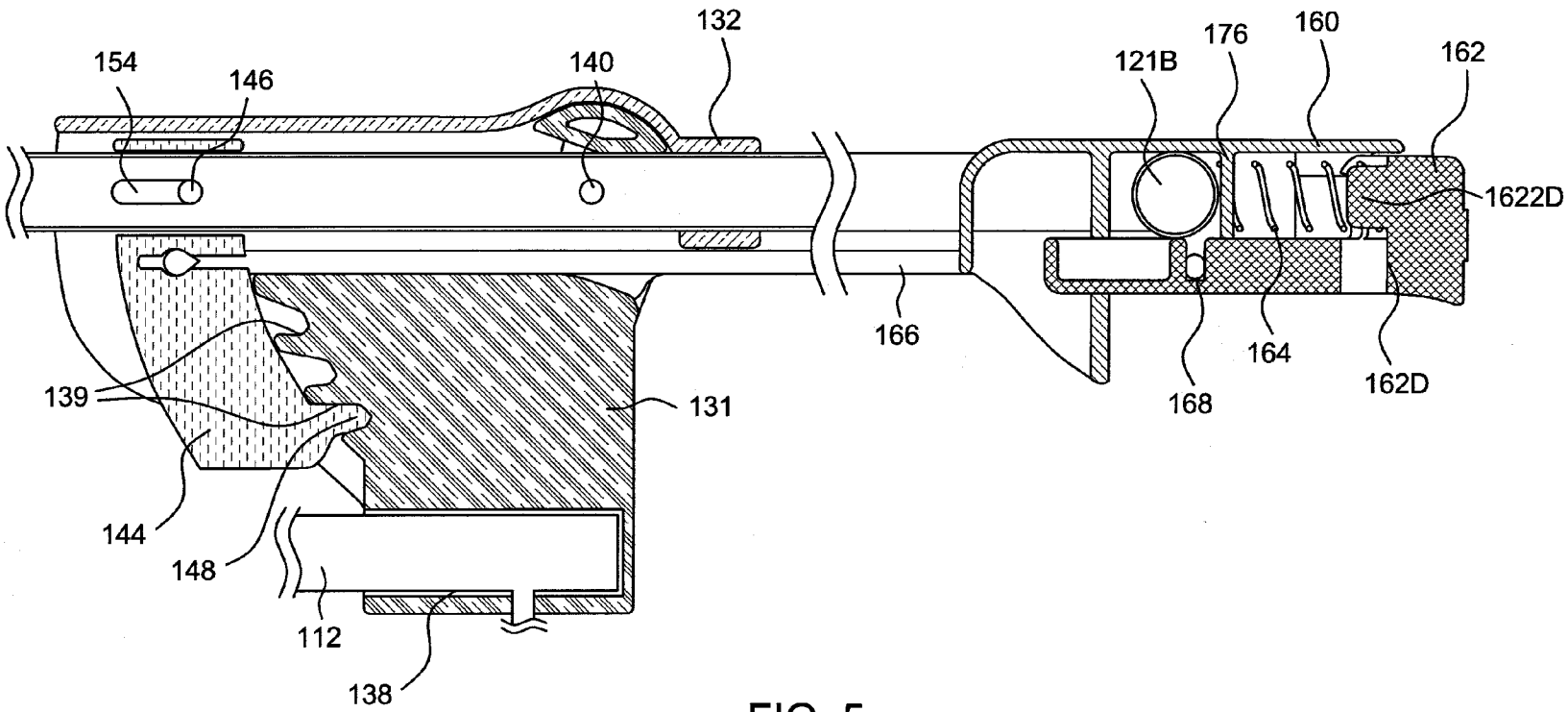
FIG. 5 is a schematic view illustrating another embodiment of the second pivot joint.

FIG. 5 is a schematic view illustrating another embodiment of the second pivot joint 130. In FIG. 5, the latching member 144 is in the first position, causing the engaging end 148 to engage with one locking location 139. Main differences between the embodiment shown in FIG. 5 and the embodiment shown in FIG. 2 include the position of the first coupling element 131 that is interchanged with the position of the latching member 144, i.e., the latching member 144 is placed on the left of the first coupling element 131 (as shown in FIG. 5) rather than on the right of the first coupling element 131 (as shown in FIG. 2). Moreover, the handle 162 no longer has a recessed region 162C (as shown in FIG. 2), and includes a protrusion 1622D projecting from an outer surface 162D of the handle 162. In addition, the spring element 164 is assembled along the sliding direction of the handle 162 between the protrusion 1622D and an inner sidewall 176 extending downward.

Figure 6:
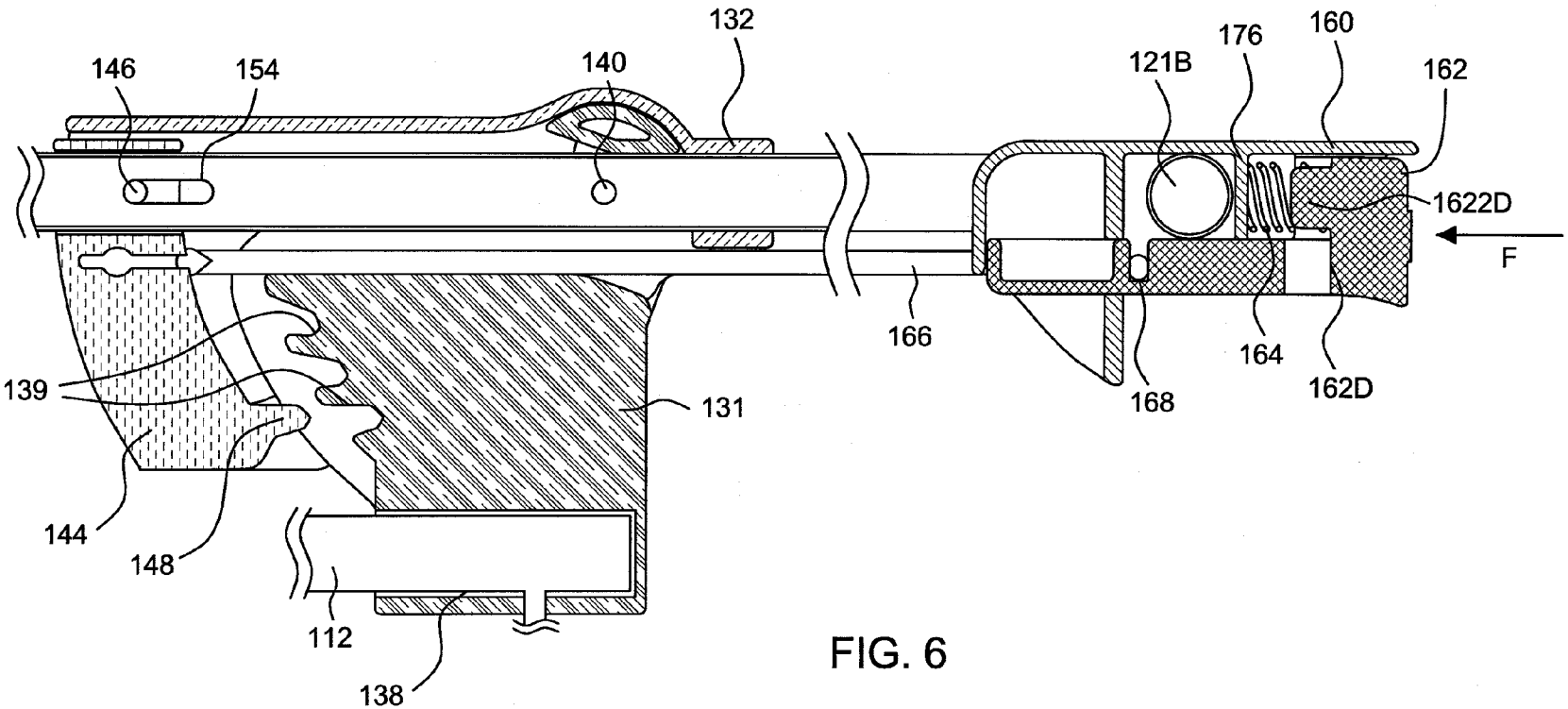
FIG. 6 is a schematic view illustrating the embodiment of the second pivot joint of FIG. 5 in an unlocked state.

FIG. 6 is a schematic view illustrating the embodiment shown in FIG. 5 in an unlocked state. A user can push the handle 162 along the direction F (generally parallel to the direction of extension of the tubular structure 121) toward the interior of the casing 160, causing the latching member 144 to move toward the left side from the position shown in FIG. 5 to the position shown in FIG. 6. As a result, the engaging end 148 of the latching member 144 can disengage from the locking location 139, turning the second pivot joint 130 to the unlocked state. As the handle 162 is being pushed for unlocking the second pivot joint 130, the spring element 164 is also compressed by the handle 162 to store elastic energy. Once the handle 162 is released, the spring element 164 can accordingly exert a resilient force to urge the latching member 144 to recover its initial position engaged with one locking location 139 (as shown in FIG. 5). Accordingly, this alternate embodiment can also allow adjustment of the inclination of the seat assembly 102 in a convenient manner.

It is understood that the aforementioned embodiments can be used in diverse nursery apparatus, such as a rocking chair, swing apparatus or cradle, etc.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A child seating apparatus comprising:

a support frame;

a seat assembly mounted with the support frame;

at least one pivot joint, including a first coupling element connected with the support frame, a second coupling element connected with the seat assembly and pivotally assembled with the first coupling element, and a latching member movable between a first position and a second position, the first position of the latching member locking the first and second coupling element in position, and the second position of the latching member unlocking the second coupling element from the first coupling element; and an actuating mechanism, including a casing and a handle, wherein the handle is movably assembled through the casing and is connected with the latching member via a link element, whereby the handle is operable to cause the latching member to move from the first position to the second position.

2. The child seating apparatus according to claim 1, wherein the actuating mechanism further includes a spring element connected with the handle and operable to bias the latching member to move from the second position to the first position.

3. The child seating apparatus according to claim 1, wherein the seat assembly includes a seating portion, and the actuating mechanism is provided at a front of the seating portion.

4. The child seating apparatus according to claim 1, wherein the support frame includes at least one support leg and a swing arm, and the seat assembly is connected with the swing arm via the pivot joint.

5. The child seating apparatus according to claim 1, wherein the seat assembly is operable to rotate relative to the support frame for adjusting an inclination of the seat assembly, while the latching member is kept at the second position.

6. The child seating apparatus according to claim 1, wherein the first coupling element includes a plurality of locking locations, and the latching member has an engaging end that is adapted to engage with one of the locking locations when the latching member is at the first position, and is adapted to disengage from any one of the locking locations when the latching member is at the second position.

7. The child seating apparatus according to claim 1, wherein the handle is moved from the first position to the second position via either of a pulling action and a pushing action exerted thereon.

8. A method of operating a child seating apparatus, comprising:

providing a child seating apparatus that comprises a support frame, a seat assembly, at least one pivot joint and an actuating mechanism, wherein the pivot joint includes a first coupling element connected with the support frame, a second coupling element coupled with the seat assembly, and a latching member, and the actuating mechanism includes a casing and a handle that is movably assembled through the casing and is connected with the latching member via a link element;

locking the first coupling element with the second coupling element by biasing the latching member to a first position;

causing the latching member to move from the first position to a second position that unlocks the first and second coupling elements; and rotating the seat assembly to a different inclination relative to the support frame.

9. The method according to claim 8, wherein the actuating mechanism further comprises a spring element operable to bias the handle to move from the second position to the first position.

10. The method according to claim 9, further comprising releasing the handle after rotating the seat assembly to a different inclination relative to the support frame, whereby the spring element acts to cause the latching member to engage with the first and second coupling element.

11. The method according to claim 8, wherein the step of causing the latching member to move from the first position to a second position includes applying either of a pulling action and pushing action on the handle.

12. A child seating apparatus comprising:

a support frame;

a seat assembly mounted with the support frame and having a tubular structure, the tubular structure having a rear corresponding to a backrest side, and a front opposite the rear;

at least one pivot joint coupled with the support frame and a side segment of the tubular structure of the seat assembly, the pivot joint including a latching member operable to lock the seat assembly in place; and an actuating mechanism arranged on the seat assembly, wherein the actuating mechanism is operable to unlock the pivot joint for allowing rotation of the seat assembly relative to the support frame, the actuating mechanism including a handle and a link element, the handle is assembled at the front of the tubular structure, and the link element extends along the tubular structure from the handle to the pivot joint and is connected with the latching member.

13. The child seating apparatus according to claim 12, wherein the support frame includes at least one support leg and a swing arm pivotally connected with the support frame, the seat assembly is mounted with the swing arm via the pivot joint.

14. The child seating apparatus according to claim 13, wherein the actuating mechanism is operable by applying either of a pulling action and a pushing action on the handle.

15. The child seating apparatus according to claim 14, wherein either of the pulling action and the pushing action causes the latching member of the pivot joint to move for unlocking the connection between the seat assembly and the swing arm, whereby the seat assembly is operable to rotate relative to the swing arm.

16. The child seating apparatus according to claim 12, wherein the actuating mechanism further includes a casing affixed with the tubular structure, and the handle is movably assembled through the casing.

* * * * *